US005403970A

United States Patent [19]

Aoki

[11] Patent Number: 5,403,970

[45] Date of Patent: Apr. 4, 1995

[54] ELECTRICAL MUSICAL INSTRUMENT USING A JOYSTICK-TYPE CONTROL APPARATUS

[75] Inventor: Eiichiro Aoki, Hamamatsu, Japan

[73] Assignee: Yamaha Corporation, Japan

[21] Appl. No.: 615,871

[22] Filed: Nov. 19, 1990

[30] Foreign Application Priority Data

Nov. 21, 1989 [JP] Japan ..... 1-300755
Nov. 21, 1989 [JP] Japan ..... 1-300756

[51] Int. Cl.[6] ..... G10H 1/06

[52] U.S. Cl. ..... 84/626; 84/644; 84/662; 84/723

[58] Field of Search ..... 200/6 A; 84/723, 743, 84/626, 644, 659, 662, 670

[56] References Cited

U.S. PATENT DOCUMENTS

| | | | |
|---|---|---|---|
| 3,056,867 | 10/1962 | Eitel | 200/6 A |
| 3,238,316 | 3/1966 | Voss | 200/8 R |
| 3,723,687 | 3/1973 | Adkinson | 200/157 |
| 3,730,964 | 5/1973 | Kaplan | 84/470 |
| 4,493,219 | 1/1985 | Sharp et al. | 73/862.05 |
| 4,501,424 | 2/1985 | Stone et al. | 273/148 B |
| 4,795,296 | 1/1989 | Jau | 414/5 |
| 4,805,510 | 2/1989 | De Dianous | 84/282 X |
| 4,882,965 | 11/1989 | McClish | 84/453 X |
| 4,932,304 | 6/1990 | Franzmann | 84/671 |
| 4,962,448 | 10/1990 | DeMaio et al. | 200/6 A |
| 4,984,276 | 1/1991 | Smith | 381/63 |
| 5,038,662 | 8/1991 | Ho | 84/723 |
| 5,107,080 | 4/1992 | Rosen | 200/6 A |
| 5,132,671 | 7/1992 | Louis et al. | 200/6 A X |
| 5,167,179 | 12/1992 | Yamauchi et al. | 84/618 |
| 5,200,568 | 4/1993 | Fukushima et al. | 84/622 |
| 5,220,117 | 6/1993 | Yamada et al. | 84/600 |

FOREIGN PATENT DOCUMENTS 63-40199 2/1988 Japan .

*Primary Examiner*—William M. Shoop, Jr.
*Assistant Examiner*—Brian Sircus
*Attorney, Agent, or Firm*—Graham & James

[57] ABSTRACT

A control apparatus, for an electronic musical instrument and other electronic apparatuses, comprises a freely operable operation rod having an operation gripping portion at a distal end of the rod, X- and Y-position detectors for respectively detecting X- and Y-positions of the operation rod, and a pressure or rotation amount detector for detecting an operation pressure operating on the operation rod or a rotational amount of the operation rod about an axis thereof. The control apparatus can input a pressure or rotational amount detection signal of the operation rod to a control object together with X- and Y-position detection signals. An electronic musical instrument has the control apparatus as a performance operation member for controlling electronic tone generation parameters in correspondence with a performance function of a kind of instrument, and a physical sound source for generating an electronic tone on the basis of inputs from a keyboard and the performance operation member.

27 Claims, 10 Drawing Sheets

CHTBL

| | |
|---|---|
| CHF(0) | CHKCD(0) |
| CHF(1) | CHKCD(1) |
| CHF(2) | CHKCD(2) |
| CHF(3) | CHKCD(3) |

ELECTRICAL MUSICAL INSTRUMENT USING A JOYSTICK-TYPE CONTROL APPARATUS

BACKGROUND OF THE INVENTION

1. Field of the Invention

The present invention relates to a control apparatus, especially, the mechanical construction thereof, for an electronic musical instrument and other electronic or electrical apparatuses, and to an electronic musical instrument, especially, an electronic musical instrument for generating an electronic tone corresponding to a bowed instrument, which uses the control apparatus as an input apparatus for controlling electronic tone generation parameter.

2. Prior Art

In an electronic apparatus, especially, in an electronic musical instrument, an input for controlling the operation thereof is made from a switch operation or a key depression and release operation on a keyboard. Therefore, the keyboard or switches on an operation panel constitute an input apparatus.

A conventional input apparatus comprising a keyboard, push buttons, or various switches has separate and independent operation sections, resulting in poor operability or operation feeling, or causing operation errors.

An electronic musical instrument which generates bowed instrument tones such as violin tones comprises a physical sound source for generating an electronic tone obtained by physically approximating a mechanical vibration of a string in correspondence with a movement of a fricative contact between the string and a bow. In such an electronic musical instrument, performance function parameters such as a bow pressure upon pressing of a string of a bowed instrument, a bow velocity, a bow position, and the like are inputted from a keyboard consisting of a plurality of keys. More specifically, a key code representing a scale, a magnitude of a tone, its length, and the like are inputted by key depression or release touches or timings on the keyboard, and operations of other switches on the keyboard.

In the conventional electronic musical instrument, since control is performed upon key ON/OFF operations on the keyboard or operations of switches on the keyboard, the switches and push buttons constitute separate input means, and a player (operator) must move his or her hands to select and operate switches or the like every time he or she wants to control musical tone parameters. Therefore, this results in poor operability for musical tone control, technical difficulty in actual performance, and a performance control operation error.

SUMMARY OF THE INVENTION

[Objects]

The present invention has been made in consideration of the above situation, and has as its first object to provide a control apparatus which has improved operability, and can input control signals for a plurality of control parameters of a control object upon operation of a single operation member.

It is a second object of the present invention to provide an electronic musical instrument for performing control inputs of performance functions of an electronic musical instrument such as a bowed instrument using a performance operation member which can simultaneously control a large number of control parameters upon operation of a single operation member.

[Arrangement of First Aspect]

In order to achieve the first object, a control apparatus of a joystick-type according to the first aspect of the present invention, comprises a freely operable operation rod having an operation gripping portion at its distal end, and X- and Y-position detection means for respectively detecting X- and Y-positions of the operation rod and outputting X- and Y-position detection signals, a pressure detection means for detecting an operation pressure operating on the operation rod and outputting an operation pressure signal when said operation rod is operated, and inputting means for inputting the operation pressure signal to a control object together with said X- and Y-position detection signals.

According to the present invention, the control apparatus preferably further comprises a rotation detection means for detecting a rotational amount of the operation rod about its axis, so that a rotation detection signal of the operation rod can be inputted to the control object.

The pressure detection means preferably comprises a pressure sensor for detecting a gripping pressure at the gripping portion of the operation rod.

Alternatively, the pressure detection means preferably comprises a pressure sensor for detecting an axial pressure of the operation rod.

The rotation detection means preferably comprises a rotary rheostat (rotary type variable resistor) attached to the operation rod.

[Operation]

According to the above-mentioned arrangement, when the operation rod of the control apparatus is freely pivoted to arbitrary X- and Y-positions, and a gripping pressure or an axial pressure of the operation rod is changed, a change in pressure is detected, and the pressure detection signal is inputted to a control object as a control parameter control signal together with the X- and Y-position detection signals.

[Arrangement of Second Aspect]

In order to achieve the second object, an electronic musical instrument according to the second aspect of the present invention, comprises a performance operation member comprising a joystick-type control means for controlling musical tone generation control parameters in correspondence with performance functions, and a sound source for generating an electronic tone on the basis of inputs from a keyboard and a performance operation member.

The joystick-type control means comprises a pivotally operable operation rod, X- and Y-position detection means for respectively detecting X- and Y-positions of the operation rod, and preferably further comprises a pressure detection means for detecting an operation pressure effected on the operation rod when the operation rod is operated.

Preferably, the operation rod is rotatable about its axis, and the control means comprises rotational position detection means for detecting a rotational position of the operation rod about its axis.

[Operation]

Upon operation of the operation rod of the control means, control signals for musical tone parameters are inputted according to an operation state of the operation rod. The performance operation member generates control signals according to, e.g., a bow position, bow velocity, and bow pressure of a bowed instrument.

The performance operation member controls the sound source on the basis of the position, moving speed, moving direction, operation pressure, and rotation about an axis of the operation rod of the joystick-type control apparatus.

DETAILED DESCRIPTION OF THE PREFERRED EMBODIMENTS

The preferred embodiments of the present invention will be described below with reference to the accompanying drawings.

Figure 1:
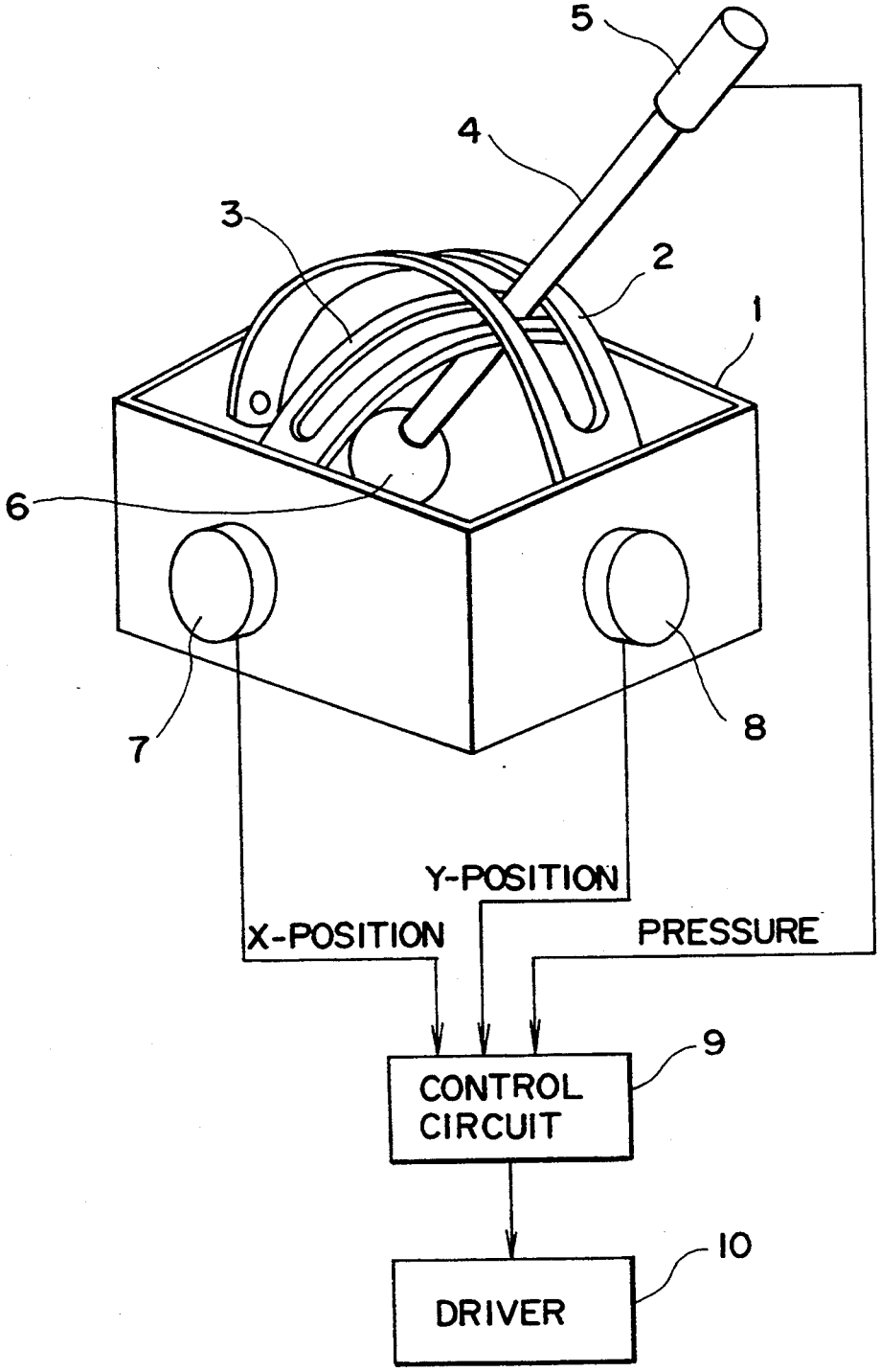
FIG. 1 is a perspective view showing an outer appearance of an input control apparatus of a joystick-type according to the present invention.

FIG. 1 is a perspective view of an input operation member (joystick-type control apparatus) comprising a joystick mechanism according to the present invention. X-and Y-guide arms 2 and 3 are rotatably arranged in a housing 1. A joystick operation rod 4 is inserted in the intersection of elongated holes formed in the guide arms 2 and 3. An operation gripping portion 5 is formed at the distal end of the operation rod 4. The operation rod 4 is pivotally supported on the housing 1 through a rotatable member 6. X- and Y-pivot position detectors 7 and 8 each comprising a rotary rheostat are attached to pivot axis receiving portions of the X- and Y-guide arms 2 and 3.

A pressure sensor (to be described later) for detecting a gripping pressure is arranged on the gripping portion 5 of the operation 4.

The X- and Y-pivot position detectors 7 and 8 and the pressure sensor of the gripping portion 5 are connected to a control circuit 9. The control circuit 9 is connected to, e.g., a driver 10 of an electronic musical instrument such as a sound source of an electronic musical instrument (to be described later).

In the input control apparatus with the above arrangement, the operation rod 4 as an input operation member can be freely pivoted in the X- and Y-directions like in the conventional joystick mechanism, and its pivot positions are detected as changes in resistance of the rotary rheostat of the X- and Y-pivot position detectors 7 and 8. In this invention, an operation pressure such as a gripping pressure of the operation rod 4 of the joystick mechanism is detected. The detected pressure signal is inputted to the control circuit 9 together with the X- and Y-position detection signals. The control circuit 9 performs predetermined arithmetic processing of parameters necessary for controlling the driver 10 on the basis of the X- and Y-position detection signals and the operation pressure detection signal of the operation rod 4, and inputs control signals of the control parameters to the driver 10.

Figure 2:
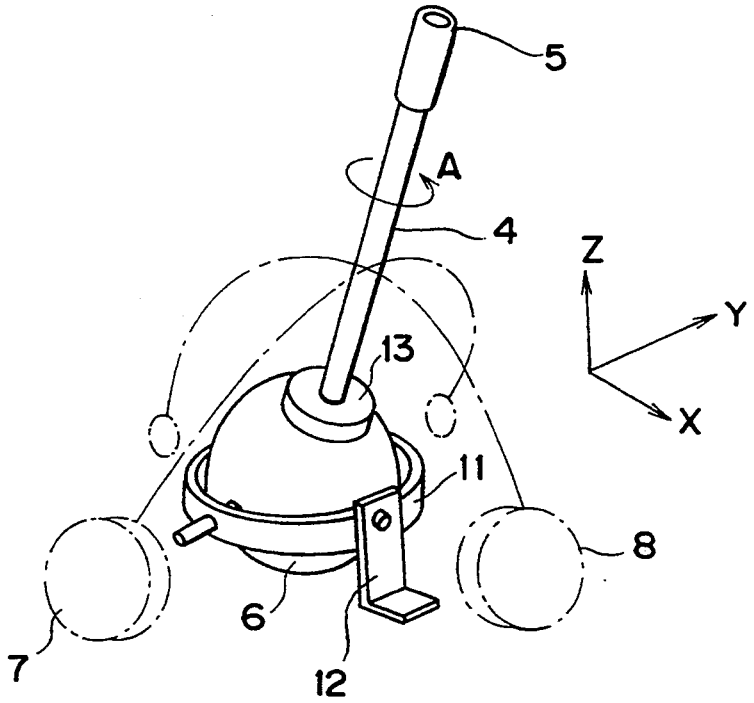
FIG. 2 is a perspective view showing a main part of another input control apparatus according to the present invention.

FIG. 2 is a perspective view of a main part according to another embodiment of the present invention.

In this embodiment, a rotation sensor 13, comprising a rotary rheostat, for detecting rotation of the operation rod 4 about its axis is attached to the operation rod 4 in addition to the above-mentioned detection sensor for detecting the operation pressure. The operation rod 4 of the joystick mechanism is attached to the rotatable member 6, which is mounted on a ring 11 to be rotatable about the Y-axis. The ring 11 is mounted on support arms 12 fixed to the bottom surface of the housing to be rotatable about the X-axis. With this arrangement, the rotatable member 6 is rotatable with respect to the housing 1 (see FIG. 1). The rotation sensor 13 is attached to the base end portion of the operation rod 4, and detects a rotation (arrow A) of the operation rod 4 about its axis as a change in resistance of the rotary volume. When an operator stops rotation of the operation rod 4 and releases his or her hand from it, the operation rod 4 can be returned to an original position (reference position where a rotational angle=0) by a spring (not shown). A stopper means may be added to align and hold the operation rod 4 at the reference position.

In this structure, upon operation of the operation rod 4, the X- and Y-positions of the operation rod 4 can be detected by the X- and Y-pivot position detectors 7 and 8, and the operation pressure and axial rotational position detection signals are also obtained. A total of four detection signals can be used as control input signals for control parameters.

A rotation detection means of the operation rod 4 is not limited to the rotary rheostat. For example, a ring provided with a magnetic pattern, a black-and-white pattern, or a through hole pattern may be fixed to the operation rod, and a magnetic sensor or a reflection or transmission optical sensor for detecting these patterns may be used.

Figure 3A:
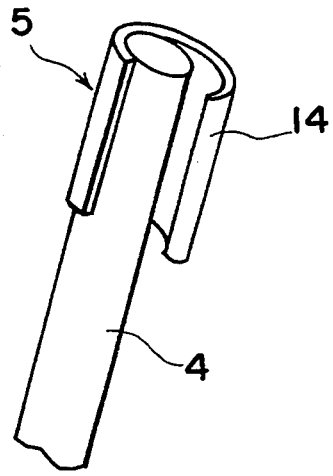
FIGS. 3A and 3B are views for explaining an arrangement of an input operation rod according to the present invention.
Figure 3B:
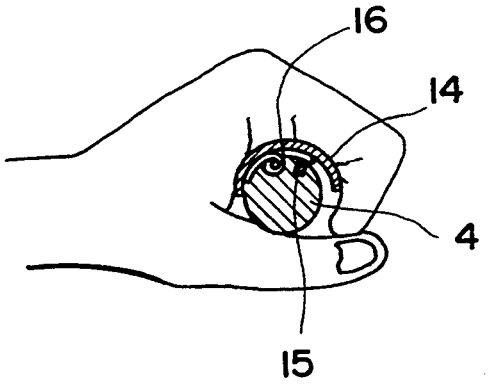

FIGS. 3A and 3B show an arrangement of the gripping portion 5 of the operation rod 4 as the input operation member of the control apparatus according to the present invention.

A gripping segment 14 is fixed to the distal end portion of the operation rod 4, as shown in FIG. 3A. The gripping segment 14 is biased by a spring 16 (or by elasticity of the gripping segment itself) in a direction to be spaced away from the outer peripheral surface of the operation rod 4 when it approaches the outer peripheral surface to some extent. A pressure sensor 15 is arranged on the inner surface of the gripping segment 14. As shown in FIG. 3B, when the gripping portion 5 is gripped by a hand, the gripping segment 14 is deformed inwardly according to a gripping strength, and the pressure sensor 15 generates a detection output according to the deformation amount. Thus, the gripping strength of the operation rod 4 can be detected.

An operation pressure detection means of the operation rod 4 may comprise a detection means for detecting an axial pressure of the operation rod in place of or in addition to the gripping pressure detection means.

Figure 4A:
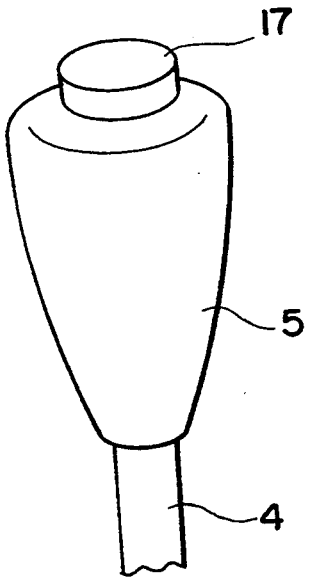
FIGS. 4A and 4B are views for explaining an arrangement of a pressure detection means of the input operation rod.
Figure 4B:
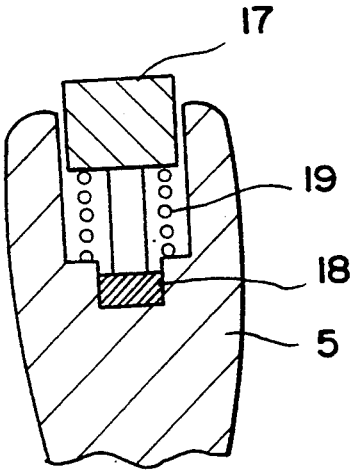

FIGS. 4A and 4B show such an axial pressure detection means.

A push button 17 is attached to the end portion of the gripping portion 5 of the operation rod 4 (FIG. 4A). The push button 17 is attached to press a pressure sensor 18 arranged in the gripping portion 5. Reference numeral 19 denotes a spring. When the pressure of the push button 17 is released, the spring 19 pushes up the push button 17 to restore it to an original position.

In this arrangement, when an operator depresses the push button 17 while gripping the gripping portion 5, the push button 17 is pressed down according to the pressure, and the pressure sensor 18 detects this pressure. The detected pressure signal is subjected to predetermined arithmetic processing, and is then used as a control input signal for a control parameter of a control object.

Figure 5:
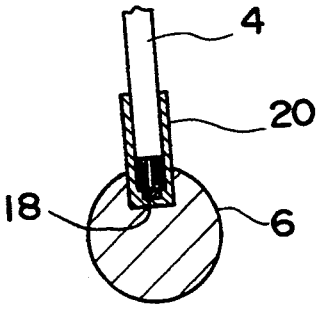
FIG. 5 is a sectional view of another pressure detection means of the operation rod.

FIG. 5 shows another axial pressure detection means of the operation rod.

In this case, a sleeve 20 is attached to the rotatable member 6 at the lower end portion of the operation rod 4, and the operation rod 4 is inserted and a pressure sensor 18 is provided in this sleeve 20. When the operation rod 4 is axially pressed toward its lower end portion, this pressure is detected by the pressure sensor 18.

In the embodiment shown in FIG. 5, the pressure sensor 18 may be arranged not in the lower end portion of the operation rod 4 but in a middle portion thereof.

Figure 6:
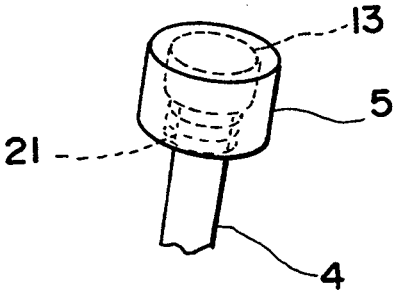
FIG. 6 is a view for explaining another rotation detection means of the operation rod.

FIG. 6 shows another axial rotation detection means of the operation rod 4.

In this embodiment, a rotation detector 13 comprising the same rotary rheostat as one attached to the lower end portion of the operation rod 4 in the embodiment shown in FIG. 2 is arranged in the gripping portion 5 at the upper end portion of the operation rod 4. Reference numeral 21 denotes a rotation return spring. Other arrangements, operations, and effects are the same as those in the above embodiments.

An electronic musical instrument when the joystick type input operation member with the arrangement of each of the above embodiments is used as an input apparatus to an electronic tone generation sound source together with a keyboard will be described below.

Figure 7:
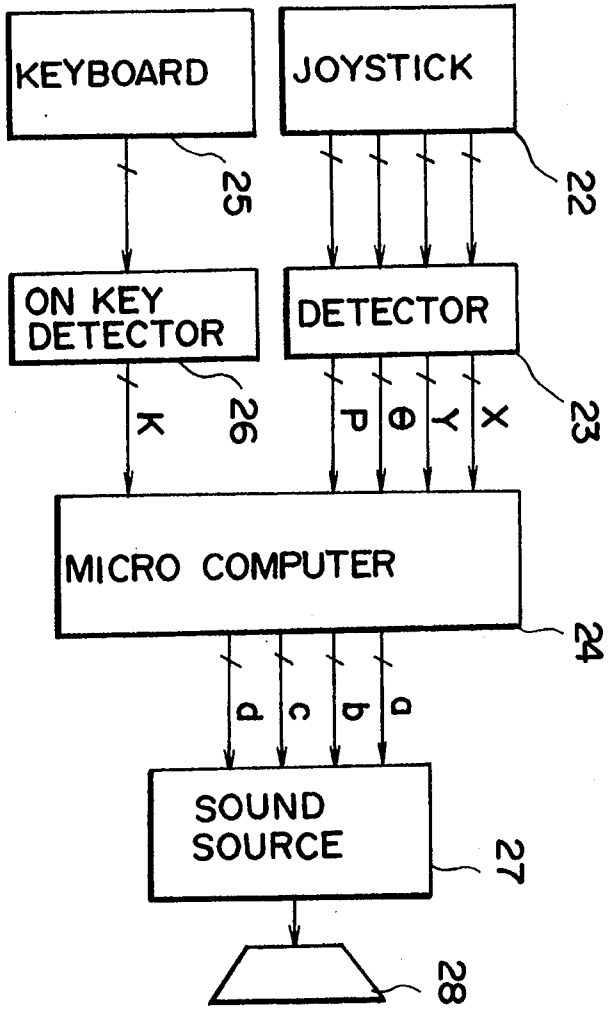
FIG. 7 is a block diagram of an electronic musical instrument using the input operation member according to the present invention.

FIG. 7 is a block diagram showing the overall arrangement of the electronic musical instrument. A performance operation member 2 comprising the above-mentioned joystick operation rod is connected to a microcomputer (CPU) 24 via a detector 23. The microcomputer 24 is also connected to a keyboard 25 via an ON key detector 26. The output terminal of the microcomputer 24 is connected to a sound source 27. The sound source 27 is connected to a sound system 28 comprising an amplifier and a loudspeaker.

X- and Y-positions, and a gripping pressure of the above-mentioned performance operation member 22 are detected by corresponding detectors (illustrated as the detector 23 as a whole in FIG. 7) as performance function control parameters such as a bow velocity and a bow pressure of a bowed instrument such as a violin. Signal lines X, Y, Θ and P in FIG. 7 represent the detection signals of X-position, Y-position, rotational amount and pressure of the operation rod 4, respectively. These detection signals are converted into signals which can be used as position data, and the like by, e.g., a D/A converter, and the converted signals are inputted to the microcomputer (CPU) 24. An ON key depressed upon operation of the keyboard 25 is detected by the ON key detector 26. The ON key detection signal is converted into a key code representing a frequency of a predetermined tone number, and the converted frequency is inputted to the microcomputer 24. A signal line K represents a key code detection signal of the ON key.

The microcomputer 24 performs predetermined arithmetic processing on the basis of the detection signals to calculate a bow velocity signal a, a bow pressure signal b, a pitch signal c, and other parameters d such as a decay coefficient, and inputs them to the sound source 27. A musical tone is synthesized in the sound source 27 on the basis of the parameters controlled upon operation of the performance operation member 22, and is outputted as a performance tone of a bowed instrument such as a violin by the sound system 28.

The relationship between the detection signal of the performance operation member and control input parameters of the sound source will be described in detail below.

Figure 8:
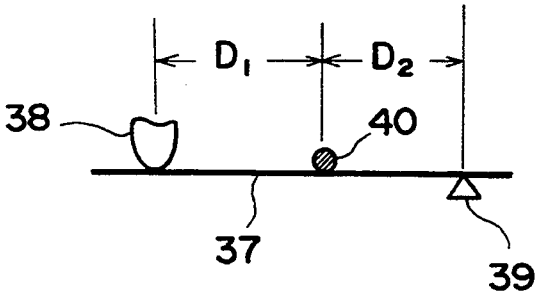
FIG. 8 is a view showing the positional relationship between a string and a bow.

FIG. 8 shows a model of a string and a bow of a bowed instrument. Reference numeral 37 denotes a string; 38, a finger position; 39, a bridge; and 40, a bow position. A distance between the finger 38 and the bow 40 is represented by D1, and a distance between the bridge 39 and the bow 40 is represented by D2. D1+D2 is determined by a key code. D1 and D2 correspond to delay times of a musical tone synthesis/delay circuit (to be described later), and correspond to resonance frequencies of string portions on two sides of the bow 40.

An operation speed is calculated as $V=(\Delta X^2+\Delta Y^2)^{\frac{1}{2}}$ on the basis of changes ΔX and ΔY in X- and Y-position data of the above-mentioned joystick operation rod. An operation direction (clockwise direction or counterclockwise direction) of the joystick is distinguished on the basis of the sign of changes in these position data. The Data such as the X- and Y-positions, the operation speed, operation direction, and above-mentioned pivotal rotation angle and gripping or operation pressure P are used as musical tone control parameters corresponding to a bow velocity, a bow position, a bowed string position, a bow pressure, and the like. Correspondences between detected arithmetic data and control parameters can be appropriately combined according to kinds of electronic musical instrument, an arrangement of a sound source, and the like.

Figure 9:
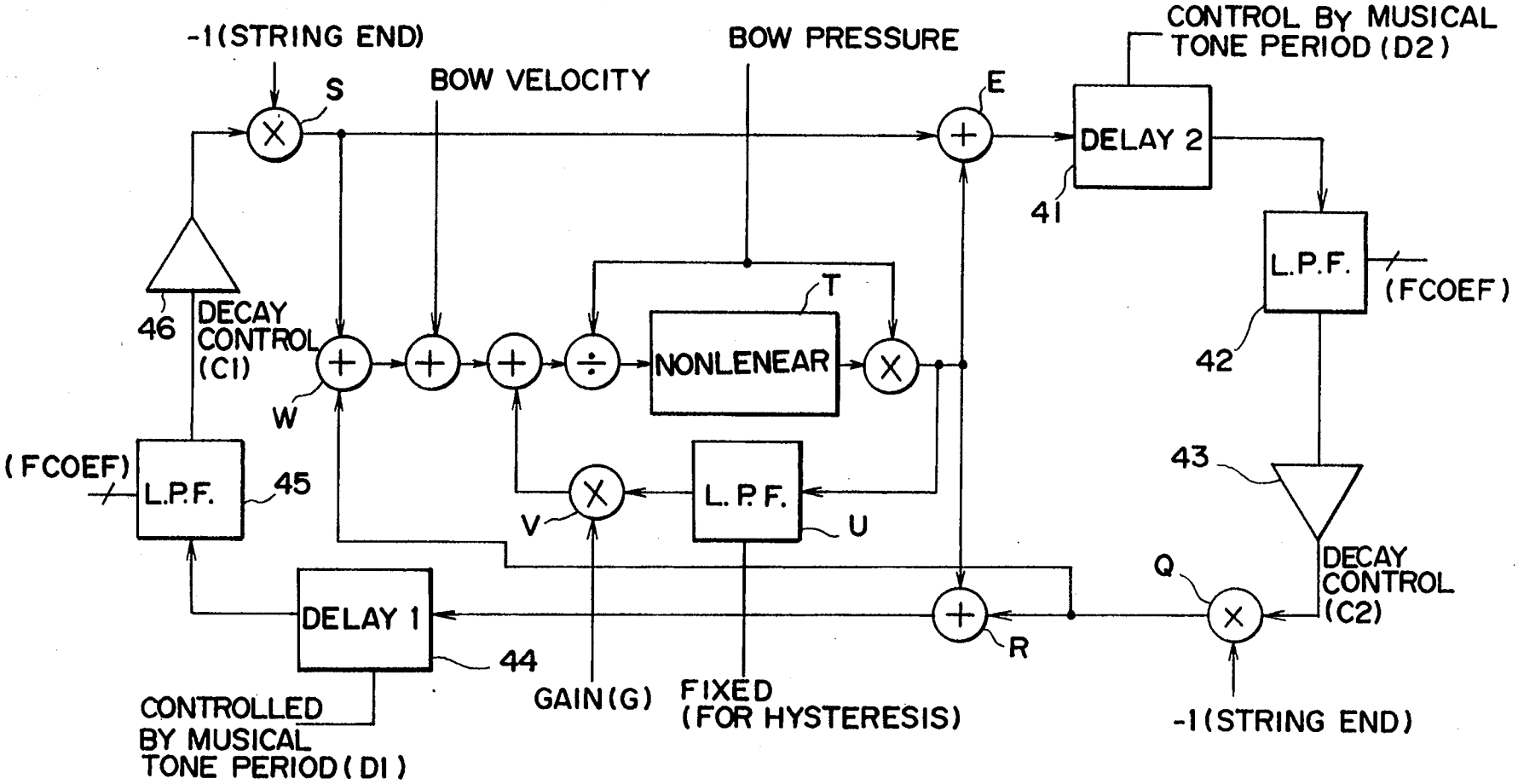
FIG. 9 is a circuit diagram showing a sound source.

FIG. 9 shows a circuit arrangement of a physical sound source for synthesizing such an electronic tone corresponding to the model of the string and the bow. Reference symbols E and R denote adders which correspond to a bowed point (the bow 40 in FIG. 8); and Q and S, multipliers which correspond to string ends (the positions of the finger 38 and the bridge 39 shown in FIG. 8) on two sides of the bowed point. A closed loop constituted by the adder E, a delay circuit 41, a low-pass filter (LPF) 42, an attenuator 43, and the multiplier Q corresponds to a string portion on one side of the bowed point, and a delay time of the closed loop corresponds to a resonance frequency of the string. Similarly, a closed loop constituted by the adder R, a delay circuit 44, an LPF 45, an attenuator 46, and the multiplier S corresponds to a string portion on the other side of the bowed point.

Reference symbol T denotes a nonlinear function generator. The nonlinear function generator receives a signal as a sum of a signal obtained by synthesizing outputs from the closed loops on two sides of the bowed point by an adder W, a signal corresponding to a bow velocity, a signal from a fixed hysteresis LPF U, and a gain G inputted to a multiplier V. Hysteresis control of the nonlinear function generator T is performed by a signal corresponding to the bow pressure.

In the sound source circuit with the above arrangement, a bow velocity signal is obtained by arithmetic processing of position detection signals of the operation rod of the performance operation member, and a bow pressure signal is obtained based on a gripping pressure detection signal of the operation rod. Delay times of the delay circuits 41 and 44 correspond to a bow position (i.e., D1 and D2 (FIG. 8)), and the bow position is determined on the basis of, e.g., the rotational amount detection signal Θ. Cutoff frequencies as parameters of the LPFs 42 and 45 determine a tone color of a musical tone, and are obtained on the basis of, e.g., the X-position detection signal of the operation rod. A decay speed is obtained based on the Y-position detection signal of the operation rod.

As described above, when the detection signals of the operation rod of the performance operation member are inputted as parameters for the corresponding circuits of the sound source, an electronic tone according to a bowed mode of the bowed instrument can be generated.

Figure 10:
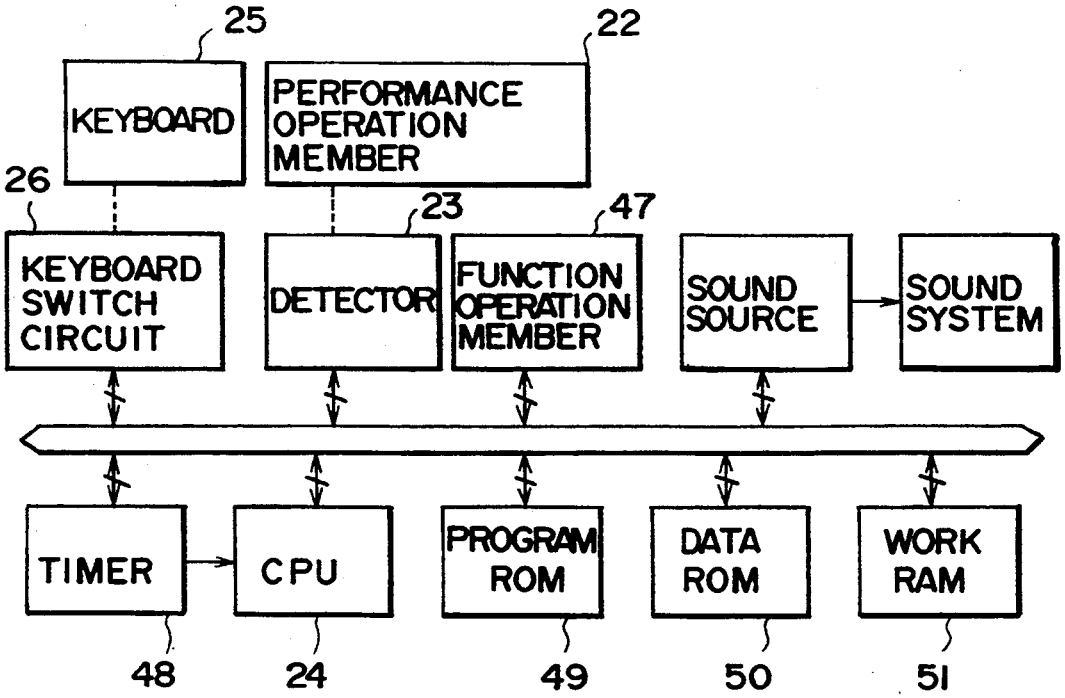
FIG. 10 is a block diagram of a musical tone control mechanism according to the present invention.

FIG. 10 is a block diagram of a control mechanism an electronic musical instrument according to the present invention. As described above, signals from the performance operation member (joystick) 22 and the keyboard 25 are inputted from a bus line to the CPU 24 via the detector 23 and the ON key detector 26. The CPU 24 reads out necessary data from a program ROM 49 for storing routine programs, a data ROM 50 for storing data necessary for arithmetic processing, and a work RAM 51 for storing intermediate calculation results in the arithmetic processing, and calculates musical tone control parameters, as described above. A function operation member 47 is normally used to select a tone color, vibrato, and the like, or to switch various modes. In this embodiment, the operation member 47 is used to switch detection modes of bow position detection and bow velocity detection, and the like. A timer 48 calls an interrupt routine for a fixed cycle of about several ms in the main routine executed by the CPU 24.

Figure 11:
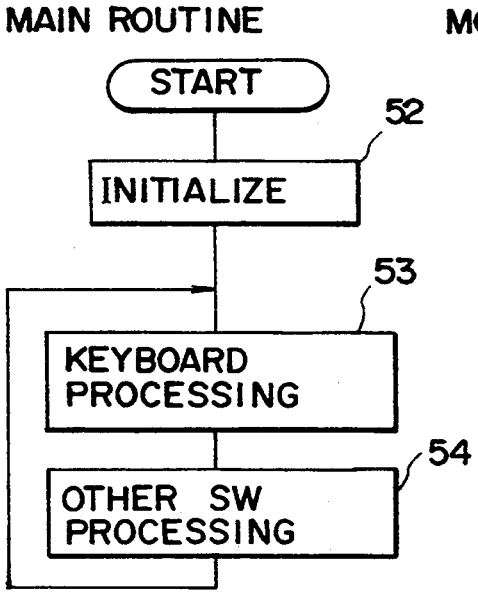
FIG. 11 is a flow chart of a main routine.

FIG. 11 shows a basic main routine. In step 52, each of the arithmetic circuit is initialized, and various musical tone parameters are set to be predetermined initial values. Thereafter, ON key switch processing (step 53) on the keyboard and other switch processing (step 54) are repeated. The interrupt routine (to be described later) is executed for a predetermined cycle by the timer (FIG. 10) in the main routine, thereby calculating the above-mentioned control input parameters.

Figure 12:
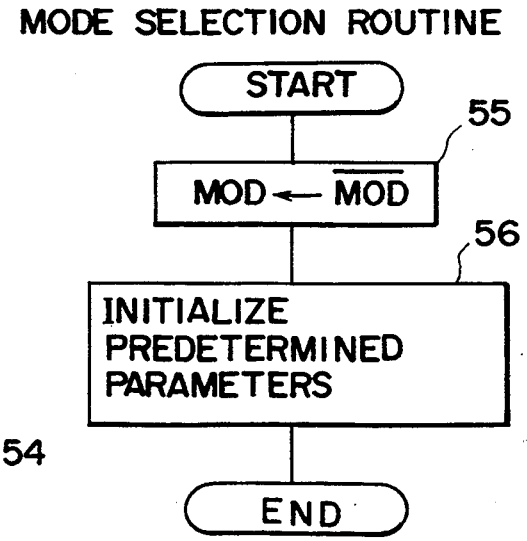
FIG. 12 is a flow chart of a mode switching routine.

FIG. 12 shows a mode switching routine. In step 55, mode switching into, e.g., a detection mode is performed, and a detection result is stored in a register for the next detection arithmetic processing. Parameters processed on the basis of detection data are initialized in step 56. More specifically, the data of previous angles X and Y are set for angle change arithmetic processing or the like (ANGXO←ANGX, ANGYO←ANGY), and a filter coefficient (FCOEF) is set to be a standard value.

Figures 13, 14, 15:
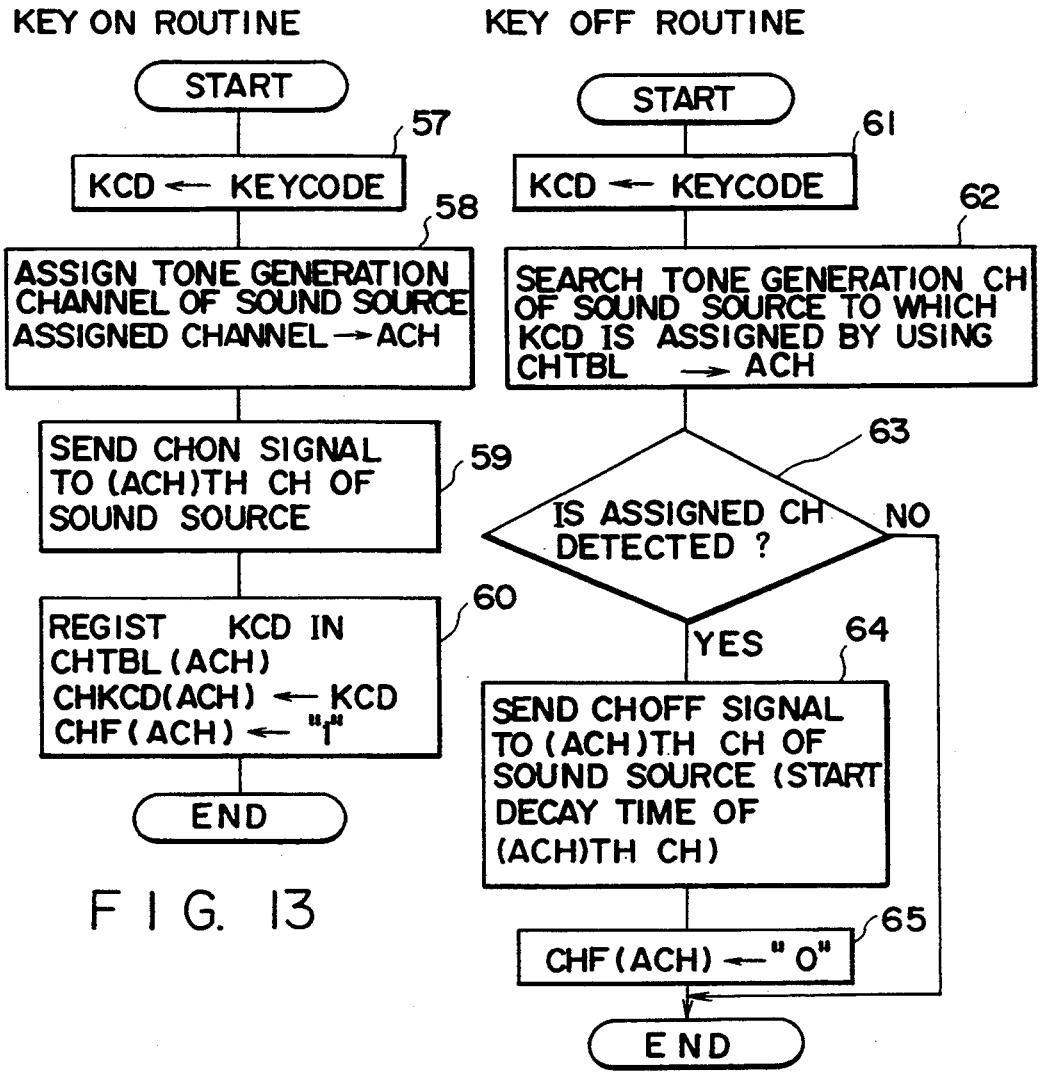
FIG. 13 is a flow chart of a key-ON routine.
FIG. 14 is an explanatory view of a channel table.
FIG. 15 is a flow chart of a key-OFF routine.

FIG. 13 shows the key-ON routine. A key code of an ON key is stored in a key code register (KCD) (step 57). A tone generation channel of the sound source is then assigned. The assigned channel is stored in an assigned channel register (ACH) (step 58). A channel ON signal is sent to the assigned channel of the sound source (step 59). A key code is registered in the assigned channel (ACH) of a channel table shown in FIG. 14 (step 60). A signal "1" is inputted to a flag of a channel in which the key code is registered.

FIG. 15 shows the key-OFF routine. A key code of an OFF key is stored in the register KCD (step 61). The tone generation channel of the sound source to which the key code is assigned is searched using the channel table (step 62). It is checked in step 63 if such a channel is detected. If NO in step 63, the routine is ended; otherwise, a channel OFF signal is sent to the detected tone generation channel of the sound source, thereby cutting a tone of this channel (step 64). At this time, a decay time of the cut tone is started. A signal "0" is inputted to a channel flag of the channel table, which flag corresponds to the OFF channel (step 65).

Figure 16:
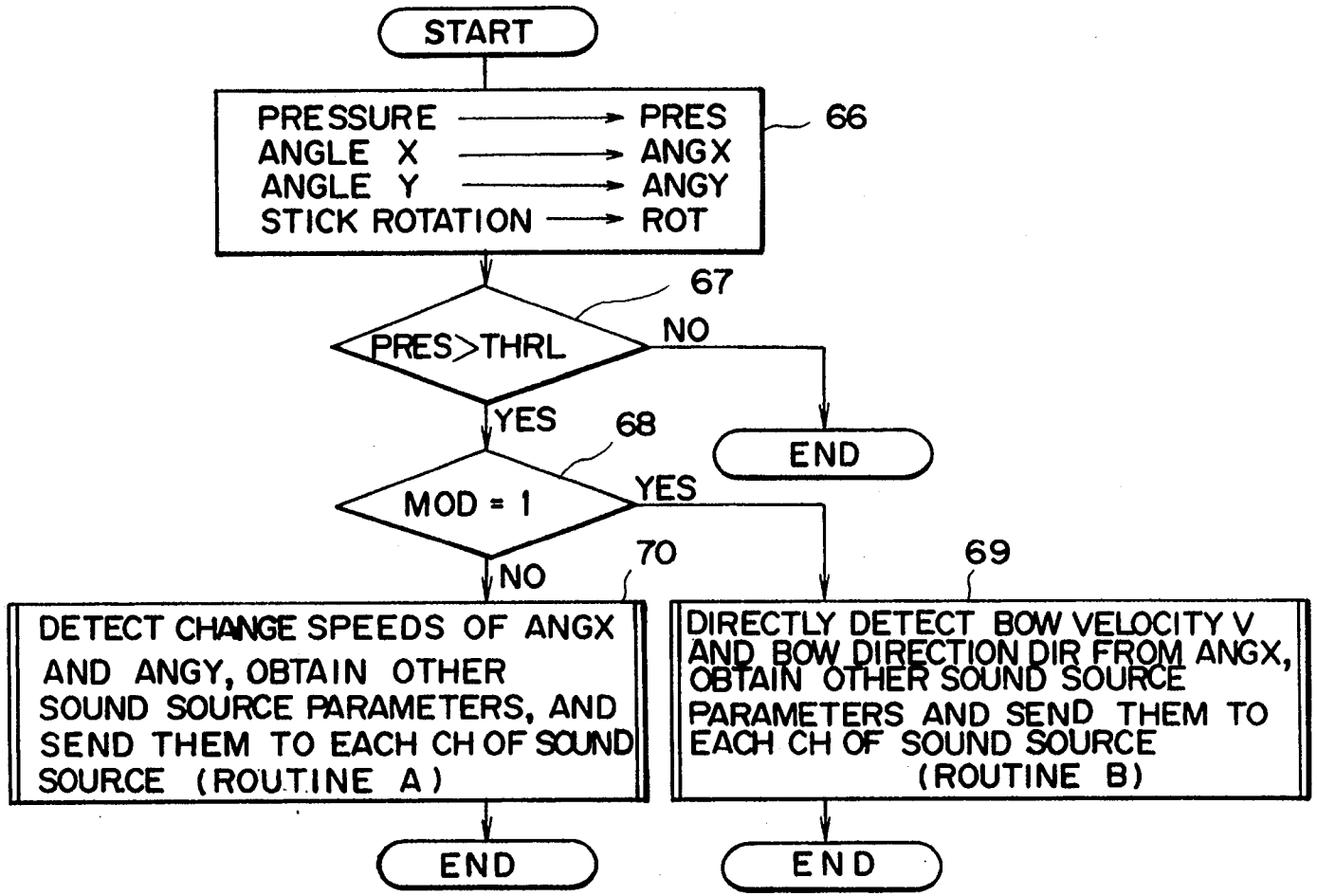
FIG. 16 is a flow chart of an interrupt routine.

FIG. 16 shows the interrupt routine which interrupts the main routine at a predetermined period in response to a fixed clock. The detection values of the performance operation member, i.e., the operation pressure P, the angles (positions) X and Y, and rotational amount Θ are stored in corresponding registers PRES, ANGX, ANGY and ROT (step 66). In step 67, it is checked if the pressure data PRES is larger than a predetermined threshold value (THRL). If the pressure PRES is up to the threshold value (THRL) in step 67, an input value is ignored as noise. However, if YES in step 67, it is checked in step 68 if a register MOD is "1". If MOD is "1", a bow velocity v and direction DIR thereof are directly obtained from the position data of the operation rod by using a table which is formed and stored in advance (step 69). Futhermore, other sound source parameters are calculated according to another routine B, and are sent to the corresponding channels of the sound source.

If it is determined in step 68 that the register NOD is "1", the control advances to step 70 and a change speed of the position Y is obtained based on a difference between the present and previous position data. At this time, since detection timing intervals are constant, the difference between the positions directly corresponds to the change speed. Furthermore, other sound source parameters are calculated according to another routine A, and are sent to the corresponding channels of the sound source.

Figure 17:
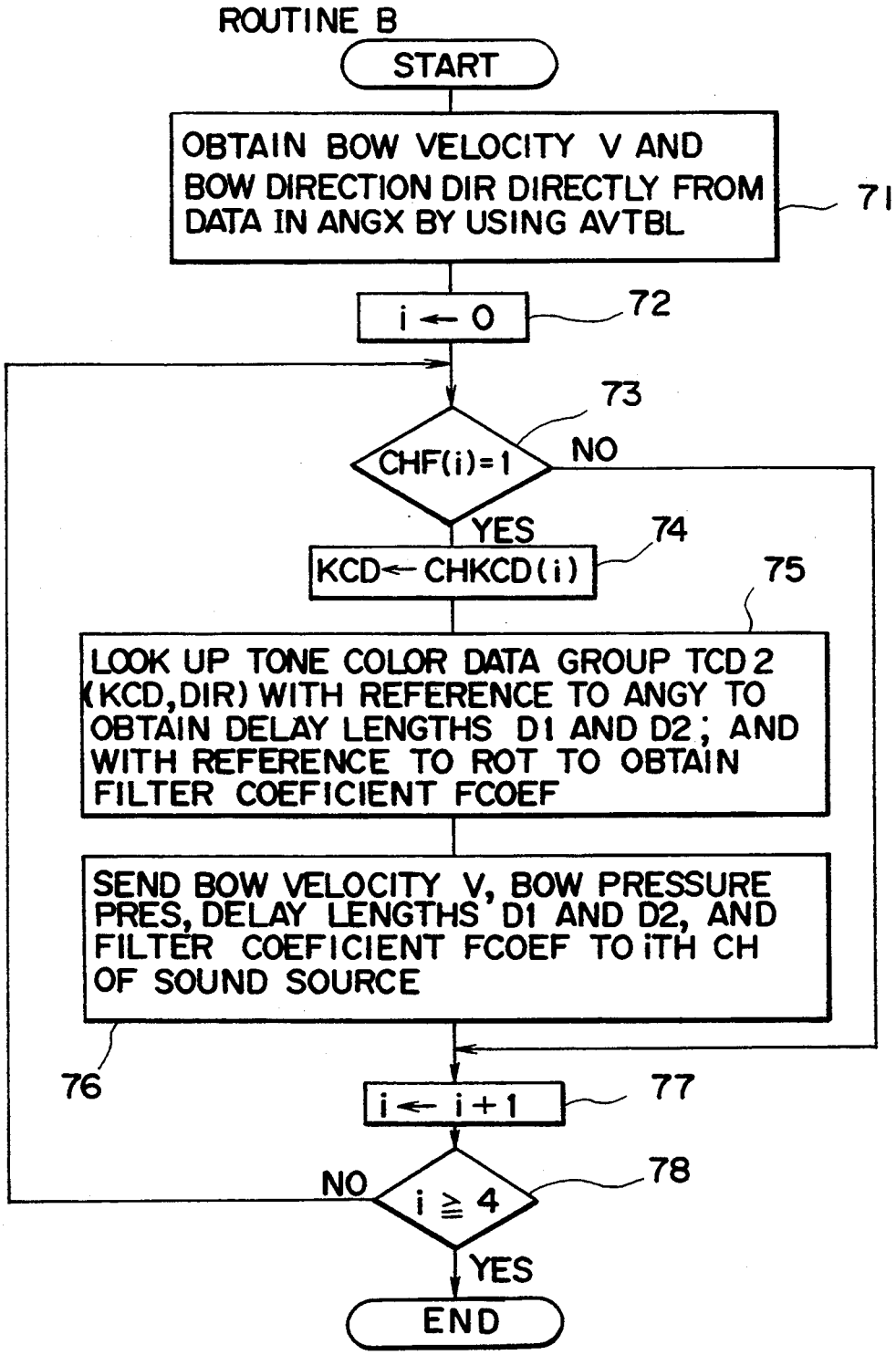
FIG. 17 is a flow chart showing an input parameter generation/output routine in one step of the routine shown in FIG. 16.

FIG. 17 shows an input routine B to the sound source in step 69 in the above-mentioned interrupt routine (FIG. 16). In step 71, the bow velocity v and the direction DIR are directly obtained based on the data of angle X with reference to the conversion table. These data of velocity v and direction DIR correspond to velocity and direction of a bowed instrument.

In this embodiment, the number of channels of the sound source is four in correspondence with the number of strings of a violin. Since a plurality of sound sources are arranged in this manner, when a key-ON signal transits from a certain channel to another channel, a reverberation effect of an original channel can be obtained. In step 72, a number i is set to check channels one by one. In step 73, it is checked if the channel flag is "1", i.e., the tone generation channel receives a key code (key-ON). If NO in step 73, the channel number is incremented by one, and the checking operation is repeated (step 77). If YES in step 73, a key code (CHKCD) of the corresponding channel is inputted to the key code register (KCD) (step 74). In step 75, musical tone parameters are obtained on the basis of the key code (KCD) data and the bow direction (DIR) data from a tone color data group TCD2. In this case, since the parameters are changed depending on DIR, a tone color is changed depending on the bow direction. Delay lengths D1 and D2 are obtained based on the angle Y. In this case, since the key code (corresponding to D1+D2) is given, D1 and D2 can be easily obtained. Filter coefficients of the LPFs 42 and 45 (FIG. 9) are obtained based on data of the rotational amount 0. Then, the bow velocity v, the bow pressure PRES, the delay lengths D1 and D2, and the Filter coefficients FCOEF are sent to the key-ON ith channel (step 76). The number i is incremented by one (step 77), and all the four channels are checked (step 78).

Figure 18:
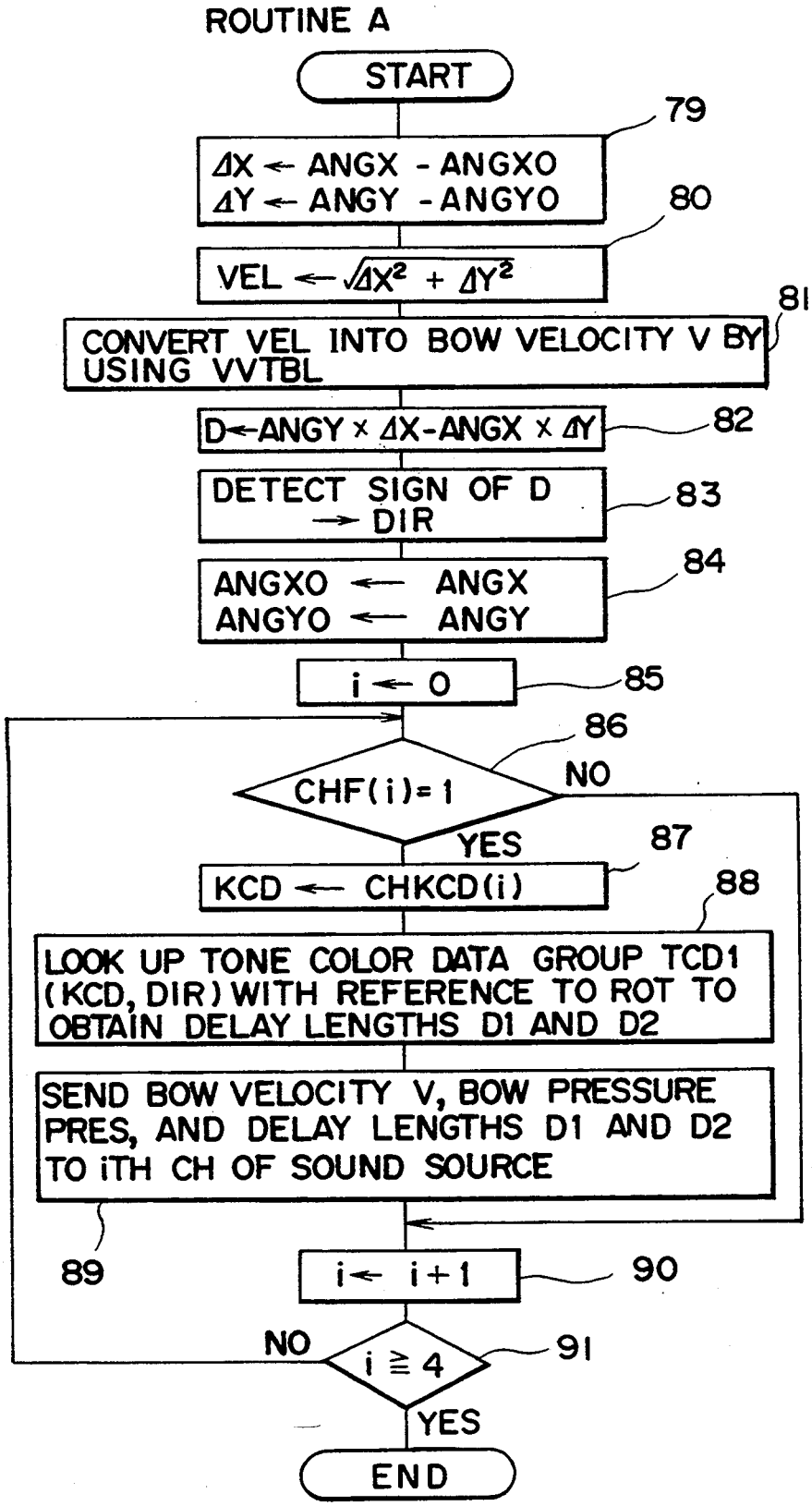
FIG. 18 is a flow chart showing an input parameter generation/output routine in another step of the routine shown in FIG. 16.

FIG. 18 shows an input routine A to the sound source in step 70 in the above-mentioned interrupt routine (FIG. 16). In step 79, a change amount $\Delta X$ is obtained on the basis of a difference between the angle X and the previous angle X. Similarly, a change amount $\Delta Y$ is obtained. On the basis of these data, $(\Delta X^2+\Delta Y^2)^{\frac{1}{2}}$ is calculated to obtain a velocity VEL (step 80). The velocity VEL converted to a bow velocity v by using a table (VVTBL) (step 81). Then, $ANGY\times\Delta X-ANGX\times\Delta Y$ is calculated to obtain a direction data D (step 82). The direction data represents a moving direction of the joystick, i.e., in which direction, clockwise or counterclockwise, the joystick is turning. A sign of the direction data is detected to obtain a bow direction DIR (step 83). The data (ANGX, ANGY) of the angles X and Y are stored in registers (ANGXO, ANGYO), respectively (step 84).

With respect to the four channels of the sound source, a number i is set in step 85 to check channels one by one. In step 86, it is checked if the channel flag is "1", i.e., the tone generation channel receives a key code (key-ON). If NO in step 86, the channel number is incremented by one, and the checking operation is repeated (step 90). If YES in step 86, a key code (CHKCD) of the corresponding channel is inputted to the key code register (KCD) (step 87). In step 88, musical tone parameters are obtained on the basis of the key code (KCD) data and the bow direction (DIR) data from a plurality of tone color data group TCD1. In this case, since the parameters are changed depending on DIR, a tone color is changed depending on the bow direction. Delay lengths D1 and D2 are obtained based on the rotational amount $\Theta$. thus, a position of the bow is determined. In this case, since the key code (corresponding to D1+D2) is given, D1 and D2 can be easily obtained. Then, the bow velocity v, the bow pressure PRES, and the delay lengths D1 and D2 are sent to the key-ON ith channel (step 89). The number i is incremented by one (step 90), and all the four channels are checked (step 91).

In the above embodiment, the sound source is not limited to the circuit shown in FIG. 9. For example, an arithmetic type sound source (FM sound source or high-frequency synthesis sound source), a waveform memory type sound source, or a composite type sound source of the former two sound sources may be used.

In the above embodiment, musical tone parameter control is attained by software control but may be realized by an exclusive hardware arrangement. In the above embodiment, an electronic musical instrument corresponding to a bowed instrument using a bow has been exemplified. However, the present invention is not limited to bowed instruments. The sound source to be controlled is not limited to polyphonic tones but may be monophonic tones. In the above embodiment, tone generation control is performed depending on key ON/OFF events on the keyboard. However, the keyboard may be used to simply designate pitches, and tone generation control may be directly performed by an input operation member.

[Effect of the Invention]

As described above, according to the present invention, upon operation of a single joystick operation rod, a plurality of control detection signals can be simultaneously obtained, and control signals for a large number of control parameters can be simultaneously inputted using these detection signals, thus improving operability and use feeling of an input operation.

When the control apparatus of the present invention is used as an input apparatus for controlling musical tone parameters of an electronic musical instrument, it can be used as a performance operation member corresponding to, e.g., a bow of a bowed instrument addition to a keyboard. Therefore, a performance feeling resembling an acoustic bowed instrument can be obtained. In addition, performance functions (operations) of the performance operation member are detected so that parameters corresponding to a bowing operation of a string and a bow of the bowed instrument can be generated and inputted to a sound source, thereby generating a synthesized tone resembling a performance tone of an acoustic bowed instrument. Upon operation of a single operation member, a large number of control parameters can be simultaneously inputted, thus improving operability during performance and obtaining good performance feeling.

What is claimed is:

1. An electronic musical instrument comprising:

a performance operation member which comprises a joystick-type control means for controlling musical tone generation control parameters in correspondence with performance functions of a kind of instrument, said joystick-type control means comprising a pivotally operable operation rod having an operation gripping portion at an end thereof, X- and Y-position detection means for respectively detecting X- and Y-positions of said operation rod, and pressure detection means for detecting a gripping pressure effected on the gripping portion of the operation rod and outputting an operation pressure signal corresponding to the detected gripping pressure and having a value which is variable within a range including plural non-zero values wherein said musical tone generation control parameters are generated on the basis of the detected X- and Y-positions and the gripping pressure; and a sound source for generating an electronic tone on the basis of said musical tone generation control parameters.

2. An electronic musical instrument comprising:

a performance operation member comprising a joystick-type control means for controlling musical tone generation control parameters in correspondence with performance functions of a particular kind of instrument comprising a pivotally operable operation rod being rotatable about its axis and having an operation gripping portion at an end thereof, X- and Y-position detection means for respectively detecting X- and Y-positions of said operation rod, and pressure detection means for detecting an operation pressure effected on the operation rod and outputting an operation pressure signal corresponding to the detected gripping pressure and having a value which is variable within a range including plural non-zero values, a rotational position detection means for detecting a rotational position of the operation rod about its axis; and a sound source for generating an electronic tone on the basis of said musical tone generation control parameters corresponding to the detected X- and Y-positions, the operation pressure and the rotational position.

3. An instrument according to claim 2, wherein said performance functions include a bow position, a bow velocity, and a bow pressure of a bowed instrument, and wherein said performance operation member generates control signals corresponding to said performance functions.

4. An instrument according to claim 2, wherein said performance operation member controls at least one of said musical tone generation control parameters on the basis of a position of said operation rod.

5. An instrument according to claim 2, wherein said performance operation member controls at least one of said musical tone generation control parameters on the basis of an operation moving speed of said operation rod.

6. An instrument according to claim 2, wherein said performance operation member controls at least one of said musical tone generation control parameters on the basis of an operation moving direction of said operation rod.

7. An electronic musical instrument as claimed in claim 2, wherein said operation pressure is a gripping pressure effected on the operation gripping portion.

8. An electronic musical instrument as claimed in claim 2, wherein said operation pressure is an axial pressure.

9. An electronic musical instrument comprising:

a pitch designation means for generating a key code;

a performance operation member comprising a joystick control means for controlling musical tone generation control parameters in correspondence with performance functions of a particular kind of instrument, said joystick control means comprising a pivotally operable operation rod having an operation gripping portion at an end thereof, X- and Y-position detection means for respectively detecting X- and Y-positions of said operation rod, and a gripping pressure detection means for detecting a gripping pressure effected on the operation rod and outputting an operation pressure signal corresponding to the detected gripping pressure and having a value which is variable within a range including plural non-zero values wherein said musical tone generation control parameters are generated on the basis of the detected X- and Y-positions and the gripping pressure; and a sound source for generating an electronic tone on the basis of inputs from said pitch designation means and said performance operation member.

10. An instrument according to claim 9, wherein said operation rod is rotatable about its axis, and rotational position detection means for detecting a rotational position of the operation rod about its axis is further provided.

11. An instrument according to claim 9, wherein said performance functions include a bow position, a bow velocity, and a bow pressure of a bowed instrument, and wherein said performance operation member generates control signals corresponding to said performance functions.

12. An instrument according to claim 9, wherein said performance operation member controls at least one of said musical tone generation control parameters on the basis of an operation moving speed of said operation rod.

13. An instrument according to claim 9, wherein said performance operation member controls at least one of said musical tone generation control parameters on the basis of an operation moving direction of said operation rod.

14. An instrument according to claim 10, wherein said performance operation member controls at least one of said musical tone generation control parameters on the basis of a rotation of said operation rod.

15. An electronic musical instrument comprising:

a joystick means having (a) a pivotally operable operation rod, and (b) X- and Y-position detection means for respectively detecting X- and Y-positions of the operation rod;

control means for calculating at least one of an operation moving speed and an operation moving direction of the operation rod based on the detected X- and Y-positions and for controlling musical tone generation control parameters respectively corresponding to performance functions of a particular kind of instrument, the control means controlling at least one of said parameters based on the calculated result; and a sound source for generating a musical tone based on the musical tone generation control parameters controlled by the control means.

16. An electronic musical instrument according to claim 15, wherein the joystick means further comprises (c) pressure detection means for detecting an operation pressure effected on the operation rod when the operation rod is operated, and the control means further controls at least one of the musical tone generation control parameters based on the operation pressure.

17. An electronic musical instrument according to claim 16, wherein the operation rod is rotatable about its axis and the joystick means further comprises (d) rotational position detection means for detecting a rotational position of the operation rod about its axis, and the control means further controls at least one of the musical tone generation control parameters based on a rotation of the operation rod.

18. An electronic musical instrument according to claim 15, wherein the operation rod is rotatable about its axis and the joystick means further comprises (c) rotational position detection means for detecting a rotational position of the operation rod about its axis, and the control means further controls at least one of the musical tone generation control parameters based on a rotation of the operation rod.

19. An electronic musical instrument according to claim 15, which further comprises a pitch designation means for generating a tone pitch signal and wherein the sound source generates a musical tone based on the musical tone generation control parameters and the tone pitch signal.

20. An electronic musical instrument comprising:

a joystick means having (a) a pivotally operable operation rod, (b) X- and Y-position detection means for respectively detecting X- and Y-positions of the operation rod, and (c) pressure detection means for detecting an operation pressure effected on the operation rod and outputting an operation pressure signal corresponding to the detected gripping pressure and having a value which is variable within a range including plural non-zero values;

a control means for controlling musical tone generation control parameters corresponding to performance functions of a particular kind of instruction based on the detected X- and Y-positions and the detected operation pressure; and a sound source for synthesizing a musical tone of the particular kind of instrument by simulating a physical sound generation mechanism of the particular kind of instrument based on the controlled musical tone generation control parameters wherein the sound source comprises:

a closed loop in which a musical tone signal is circulated, the musical tone signal corresponding to the musical tone to be generated in accordance with at least one of the controlled musical tone generation control parameters, and a delay means which delays the circulating musical tone signal by a delay time, the whole of the delay time of the closed loop corresponding to a pitch of the musical tone to be generated.

21. An electronic musical instrument according to claim 20, wherein the particular kind of instrument comprises a bowed instrument, and the performance functions comprise a bow position, a bow velocity and a bow pressure, which respectively correspond to the X- and Y-positions, the operation moving speed and the operation moving direction.

22. An electronic musical instrument as claimed in claim 20, wherein the delays constitutes a part of the closed loop, and wherein the sound source includes an excitation means receiving said musical tone signal and said musical tone generation control parameters and including a non-linear conversion means which converts the musical tone signal and at least one of the musical tone generation control parameters into an excitation signal based on a non-linear conversion characteristic, wherein said non-linear characteristic is modified by calculation based on at least one of the musical tone generation control parameters and the excitation signal is outputted to the closed loop.

23. An electronic musical instrument comprising:

a joystick means having (a) a pivotally operable operation rod rotatable about its axis, (b) X- and Y-position detection means for respectively detecting X- and Y-positions of the operation rod, (c) pressure detection means for detecting an operation pressure effected on the operation rod and outputting an operation pressure signal corresponding to the detected gripping pressure and having a value which is variable within a range including plural non-zero values; and (d) rotational position detection means for detecting a rotational position of the operation rod about its axis, and wherein the control means further controls at least one of the musical tone generation control parameters based on a rotation of the operation rod;

a control means for controlling musical tone generation control parameters corresponding to performance functions of a particular kind of instrument based on the detected X- and Y-positions, the detected operation pressure and the detected rotational position; and a sound source for synthesizing a musical tone of the particular kind of instrument by simulating a physical sound generation mechanism of the particular kind of instrument based on the controlled musical tone generation control parameters.

24. An electronic musical instrument comprising:

a joystick means having (a) a pivotally operable operation rod, (b) X- and Y-position detection means for respectively detecting X- and Y-positions of the operation rod, and (c) pressure detection means for detecting an operation pressure effected on the operation rod and outputting an operation pressure signal corresponding to the detected gripping pressure and having a value which is variable within a range including plural non-zero values;

a pitch designation means for generating a tone pitch signal;

a control means for controlling musical tone generation control parameters corresponding to performance functions of a particular kind of instrument based on the detected X- and Y-positions and the detected operation pressure; and a sound source for synthesizing a musical of the particular kind of instrument by simulating a physical sound generation mechanism of the particular kind of instrument based on the control musical tone generation control parameters wherein the sound source generates a musical tone based on the musical tone generation control parameters and the tone pitch signal.

25. An electronic musical instrument comprising:

a joystick means having (a) a pivotally operable operation rod, (b) X- and Y-position detection means for respectively detecting X- and Y-positions of the operation rod, and (c) pressure detection means for detecting an operation pressure effected on the operation rod and outputting an operation pressure signal corresponding to the detected gripping pressure and having a value which is variable within a range including plural non-zero values wherein the pressure detection means detects a gripping pressure effected on the operation rod;

a control means for controlling musical tone generation control parameters corresponding to performance functions of a particular kind of instrument based on the detected X- and Y-positions and the detected operation pressure; and a sound source for synthesizing a musical tone of the particular kind of instrument by simulating a physical sound generation mechanism of the particular kind of instrument based on the controlled musical tone generation control parameters.

26. An electronic musical instrument comprising:

a joystick means having (a) a pivotally operable operation rod, and (b) X- and Y-position detection means for respectively detecting X- and Y-positions of the operation rod;

control means for calculating an operation moving speed and an operation moving direction of the operation rod based on the detected X- and Y-positions and for controlling musical tone generation control parameters respectively corresponding to performance functions of a particular kind of instrument based on the operation moving speed and the operation moving direction; and a sound source for synthesizing a musical tone of the particular kind of instrument by simulating a physical sound mechanism of the particular kind of instrument based on the controlled musical tone generation control parameters.

27. An electronic musical instrument as claimed in claim 1, 2, 9, 15, 23, 24 or 25, wherein the sound source comprises a closed loop in which a musical tone signal is circulated, a delay means which constitutes a part of the closed loop and delays the circulating musical tone signal by a delay time, the whole of the delay time of the closed loop corresponding to a pitch of the musical tone to be generated, and an excitation means receiving said musical tone signal and said musical tone generation control parameters and including a non-linear conversion means which converts the musical tone signal and at least one of the musical tone generation control parameters into an excitation signal based on a non-linear conversion characteristic, wherein said non-linear characteristic is modified by calculation based on at least one of the musical tone generation control parameters and the excitation signal is outputted to the closed loop.

* * * * *